US005506560A

United States Patent [19]

Takeuchi et al.

[11] Patent Number: 5,506,560

[45] Date of Patent: Apr. 9, 1996

[54] ELECTRIC POWER FEEDING DEVICE BASED ON THE ELECTROMAGNETIC INDUCTION

[75] Inventors: Kazuyoshi Takeuchi; Tatsuya Uematsu; Makoto Ito, all of Kariya, Japan

[73] Assignee: Kabushiki Kaisha Toyoda Jidoshokki Seisakusho, Kariya, Japan

[21] Appl. No.: 440,882

[22] Filed: May 15, 1995

Related U.S. Application Data

[62] Division of Ser. No. 99,950, Jul. 30, 1993, abandoned.

[30] Foreign Application Priority Data

Aug. 6, 1992 [JP] Japan ..... 4-210521
Dec. 24, 1992 [JP] Japan ..... 4-343790

[51] Int. Cl.[6] ..... H01F 27/24; H01F 27/30

[52] U.S. Cl. ..... 336/83; 336/212; 336/216; 336/DIG. 2

[58] Field of Search ..... 336/83, DIG. 2, 336/212, 233, 221, 216

[56] References Cited

U.S. PATENT DOCUMENTS 2,483,815 10/1949 Easton ..... 336/DIG. 2
3,534,310 10/1970 Pelissier ..... 336/DIG. 2
3,682,098 8/1972 Spies ..... 336/DIG. 2
4,038,625 7/1977 Tompkins et al. ..... 336/DIG. 2
4,303,902 12/1981 Lesster ..... 336/DIG. 2
4,347,472 8/1982 Lemelson .
5,216,402 6/1993 Caruso .

*Primary Examiner*—Thomas J. Kozma
*Attorney, Agent, or Firm*—Brooks Haidt Haffner & Delahunty

[57] ABSTRACT

A power feeding device of three-leg core type having a primary and secondary cores which appear to be a three-leg core cut into two pieces at the legs and form a magnetic circuit including gaps by being coupled to face the cut surfaces, and a primary and secondary windings wound coaxially around the central leg section, with the primary core and primary winding constituting the power supply part and the secondary core and secondary winding constituting the power receiving part. The power feeding device based on this winding structure achieves a far better power transfer efficiency as compared with the conventional counterpart having the primary and secondary windings wound separately on a pair of E-shape cores.

8 Claims, 8 Drawing Sheets

Fig. 7a
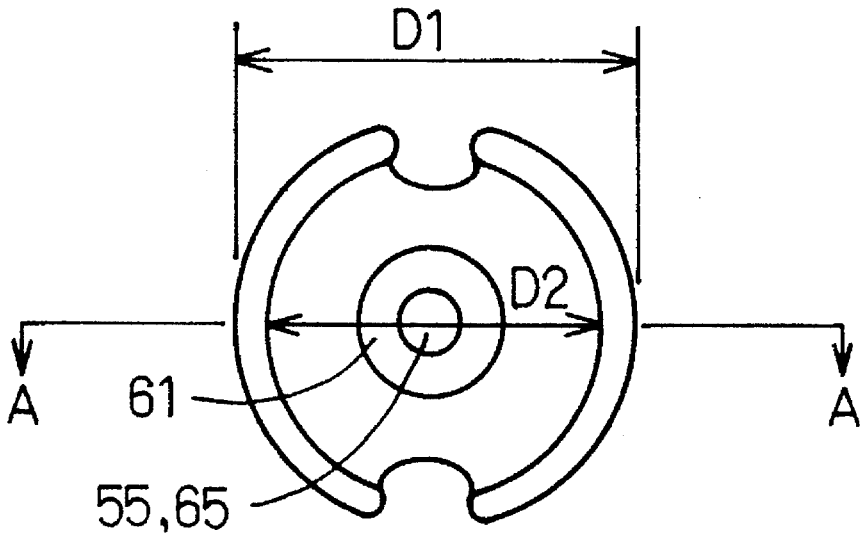
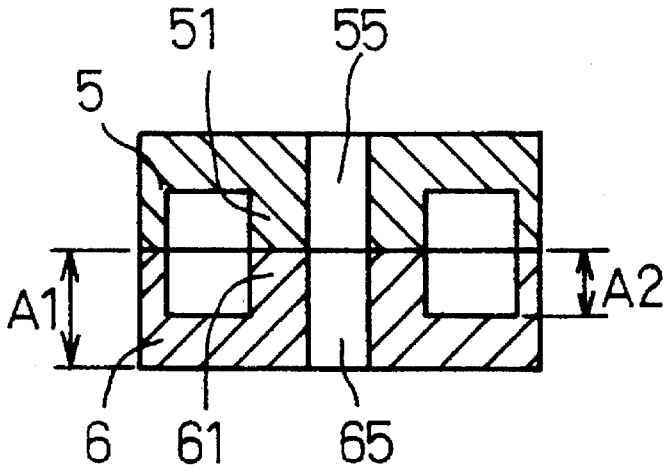
(A–A)
Fig. 7b

Fig. 9a
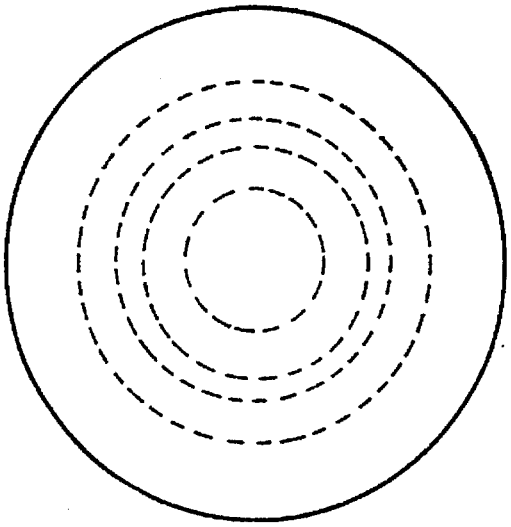
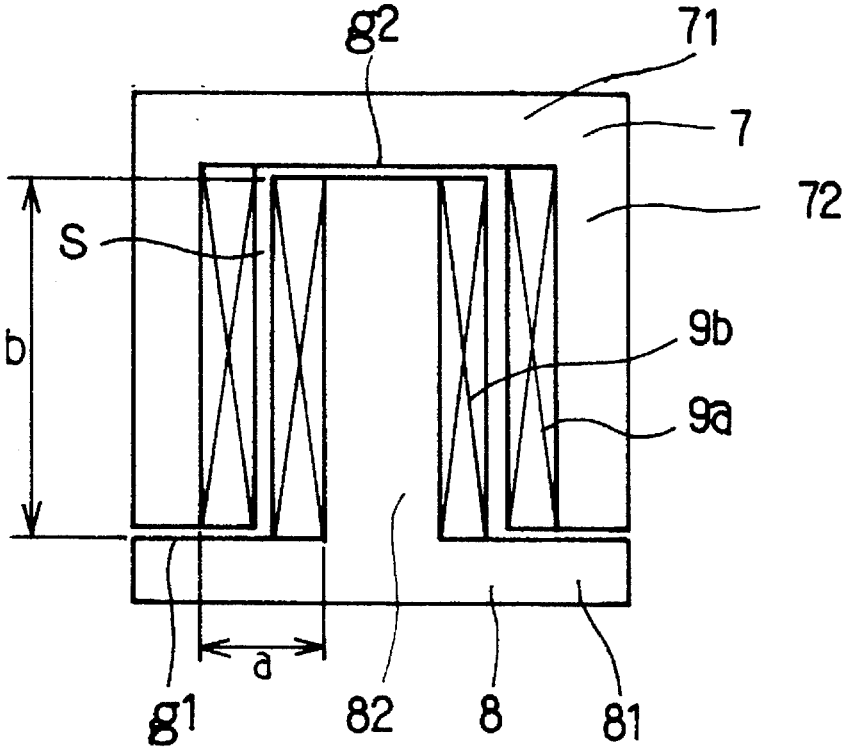
Fig. 9b

ELECTRIC POWER FEEDING DEVICE BASED ON THE ELECTROMAGNETIC INDUCTION

This application is a division continuation-in-part of application Ser. No. 08/099,950 , filed Jul. 30, 1993 now abandoned.

BACKGROUND OF THE INVENTION

The present invention relates to an electric power feeding device based on electromagnetic induction.

There has been known an electric power feeding technique in which a primary core having a primary winding and a secondary core having a secondary winding are coupled to form a magnetic circuit including gaps and power is fed from the primary winding to the secondary winding. The core structure is classified in terms of the shape of the primary and secondary cores into the channel-shape type (described in Japanese Patent Unexamined Publication No. 63-151006), the E-shape type (refer to FIG. 4), and the coaxial cylinder type (described in Japanese Patent Unexamined Publication No. 63-240331). The E-shape type and coaxial cylinder type cores are also called "three-leg cores" because of their three-leg cross section.

In the conventional power feeding device having the three-leg cores, the primary and secondary windings are wound on the respective primary and secondary copes having an E-shape cross section, and both cores are coupled for the transfer of power.

Since the three-leg, closed magnetic-path core has windings wound around a central column section, with outer column sections or a cylinder section covering the windings, it operates advantageously at little leakage of magnetic flux and therefore at high power conversion efficiency (the secondary effective power relative to the primary effective power) as compared with the channel-shape core (two-leg core)

However, in the application of the power feeding device to the electric automobile for example, there arise demands of increase in the power transfer capacity and decrease in the dimensions and weight, and it becomes necessary to raise the power frequency. It was recognized that a higher power frequency results in a larger magnetic resistance of the magnetic circuit including gaps and a significantly increased voltage drop due to the increased leakage flux.

The present invention is intended to deal with the foregoing prior art problem, and its prime object is to provide an electric power feeding device based on electromagnetic induction capable of drastically improving the power transfer efficiency.

SUMMARY OF THE INVENTION

In order to achieve the above objective, the power feeding device based on this invention includes a primary core and a secondary core which form by being coupled in a three-leg core of the closed magnetic path, and a primary winding and a secondary winding wound coaxially and concentrically around the central leg section of the three-leg core, with the primary core and primary winding constituting the power supply part and the secondary core and secondary winding constituting the power receiving part.

In a preferable form of the core structure, the central leg section has a confrontation gap on one side among the primary and secondary cores and the outer leg sections have confrontation gaps on the other side.

In a preferable form of the core structure, the three-leg core includes the above-mentioned central leg section and outer leg sections, a top plate section which connects these leg sections magnetically at one end, a base plate section which connects these leg sections magnetically at another end, and a winding accommodation space defined by the central leg section, outer leg sections, top plate section and base plate section, with the winding accommodation space having a height, which is determined from the height of said windings, set to be at least three times the lateral dimension of the winding accommodation space which is determined from the distance between the central leg section and the outer leg sections.

The present invention resides in an electric power feeding device of three-leg, closed magnetic-path core type having a primary and secondary cores which appear to be a three-leg, closed magnetic-path core cut into two pieces at the leg sections and form a magnetic circuit including gaps by being coupled to face the cut surfaces, and a primary and secondary windings wound around the central leg section of the three-leg core, with the primary core and primary winding constituting the power supply part and the secondary core and secondary winding constituting the power receiving part, wherein both windings are wound coaxially and concentrically.

According to the experiment, it was confirmed that the power feeding device based on the magnetic circuit including the confrontation gaps at the leg sections of the three-leg closed magnetic path core can reduce the voltage drop significantly through the arrangement of both windings wound coaxially and concentrically around the central leg section of the three-leg core, as compared with the conventional power feeding device based on the three-leg closed magnetic path core of the type having both windings wound separately on a pair of E-shape cores.

A conceivable reason is that the leakage flux of the primary winding emerging between the cut surfaces of the adjacent two leg sections does not intersect the secondary winding in the conventional process feeding device of three-leg closed magnetic path core type, whereas the same leakage flux intersects the secondary winding in the inventive power feeding device of three-leg closed magnetic path core type. Consequently, the inventive power feeding device can operate in the higher frequency region efficiently, and as a result it enables the size reduction and power saving.

BRIEF DESCRIPTION OF THE DRAWINGS

FIG. 7*a* and 7*b* are diagrams showing, respectively, a front view and a cross-sectional view of the power feeding device based on a second embodiment of this invention;

FIG. 9*a* and 9*b* are diagrams showing a front view and a cross-sectional view of the power feeding device based on a third embodiment of this invention.

DESCRIPTION OF THE PREFERRED EMBODIMENTS

Embodiment 1

Figure 1:
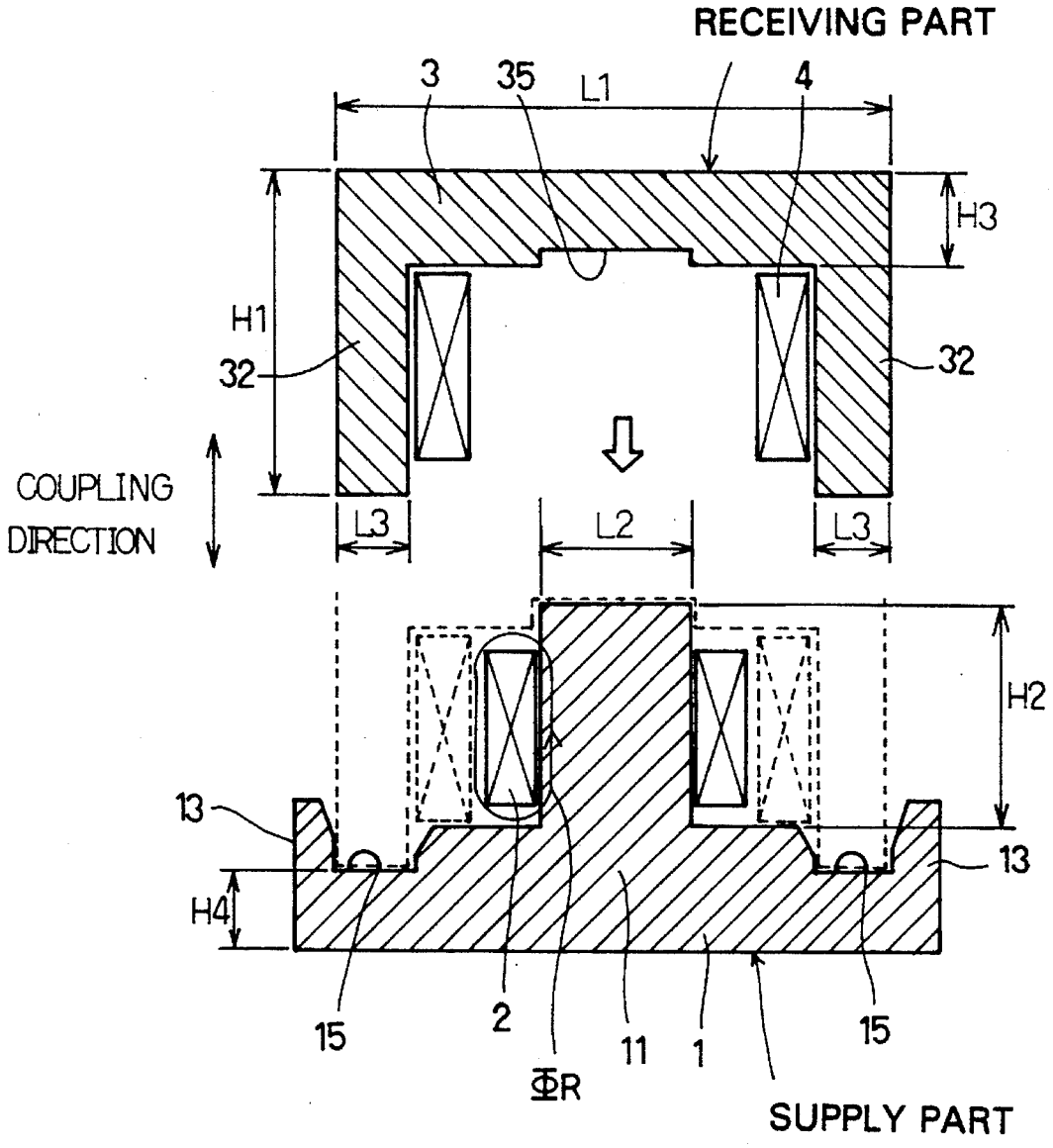
FIG. 1 is a cross-sectional diagram showing the power feeding device based on an embodiment of this invention.

FIG. 1 shows the power feeding device based on an embodiment of this invention. The device is made up of a supply part including a primary core 1 and a primary winding 2, and a receiving part including a secondary core 3 and a secondary winding 4. The supply part is fixed, while the receiving part is movable manually and automatically so that it is coupled with the supply part.

The primary core 1 and the secondary core 3 are made of electromagnetic steel or ferrite and constitute a three-leg closed magnetic path core when coupled. Specifically, the primary core 1 has its central leg section 11 facing at the end thereof a socket section 35 formed in the secondary core 3, and the secondary core 3 has its outer leg sections 32 facing at the end thereof socket sections 15 formed in the primary core 1.

The primary winding 2 is wound on the central leg section 11 of the primary core 1, and the secondary winding 4 is wound by being in contact with the inner surface of the outer leg sections 32 of the secondary core 3. Accordingly, when both cores 1 and 3 are coupled, the secondary winding 4 is disposed coaxially around the primary winding 2. The primary core 1 has the formation of a tapered outer protrusions 13 extending along the central leg section 11, and they function to reduce the magnetic resistance at the Socket section 35 by covering the end of the outer leg sections 32 and also functions to guide the coupling movement of the receiving part.

The principal design parameters are as follows. L1=100 mm, L2=30 mm, L3=5 mm, H1=45 mm, H2=35 mm, H3=7.5 mm, and H4=7.5 mm. The cores have a thickness of 25 mm (perpendicular to the drawing), and the central leg section 11 and outer leg sections 32 are shaped in cuboid. The primary winding 2 is a 10-turn winding and the secondary winding 4 is a 17-turn winding.

The following explains the operation of the foregoing power feeding device.

With both cores 1 and 3 being coupled, an a.c. voltage of several hundred Hz (in the case of electromagnetic steel core) or several kHz to several tens kHz (in the case of ferrite core) is applied to the primary winding 2. Consequently, an a.c. magnetic flux is produced in the magnetic circuit including gaps, and a secondary voltage is induced across the secondary winding 4.

In the magnetic circuit, the socket sections 15 and 35 are portions where the magnetic resistance is largest naturally. Since the power frequency is relatively high, the magnetic flux is easily conducted through the air space, causing part of the flux to escape from intersecting the secondary winding 4, resulting in a fall of the secondary voltage. This secondary voltage drop is pronounced as the secondary current increases.

In the case of the coaxial arrangement of the windings 2 and 4, as in this embodiment, a leakage flux ΦR emerges as shown by the directed line in FIG. 1. However, the dimension H2 is set large in this embodiment, making a large proportion of the airspace over the path of the leakage flux, and the leakage flux decreases owing to the large magnetic resistance. As a result, the secondary voltage drop can be alleviated.

In the foregoing embodiment, the supply part and receiving part may be exchanged and the cores may be shaped in cylinders.

Variant embodiment 1

Figure 2:
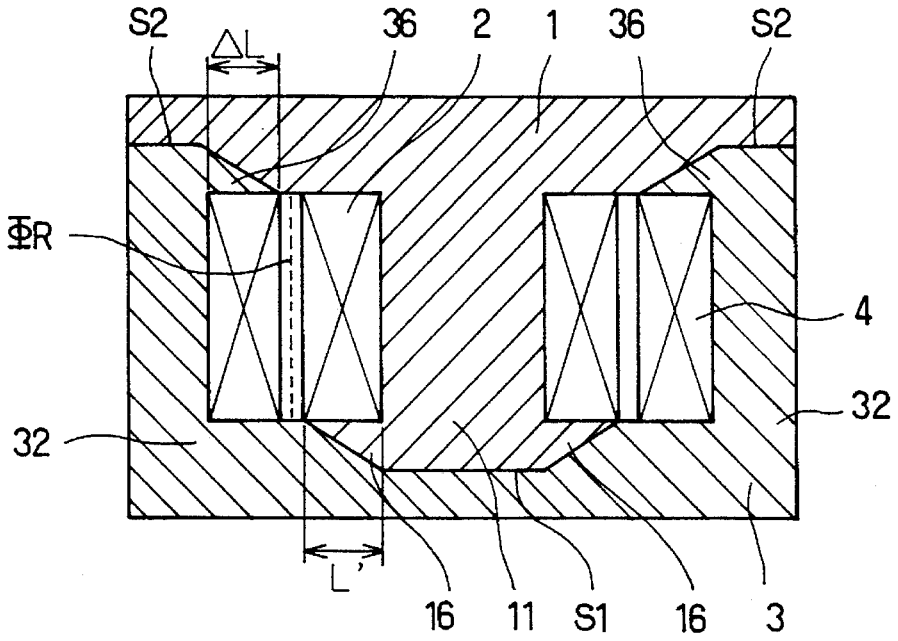
FIG. 2 is a cross-sectional diagram showing a variant embodiment.

FIG. 2 shows a variant embodiment. The primary core 1 has its central leg section 11 extending outward at the end to form an eaves section 16 of a trapezoidal cross section, and the secondary core 3 has its outer leg sections 32 extending inward at the end to form eaves sections 36 of a trapezoidal cross section. The eaves sections 16 and 36 have lengths of extensions L'and ΔL set equal to the widths of the respective windings. Each core has its top or base section cut way thereby to complementally match the shape of the eaves section of the other core.

Consequently, when the receiving part is coupled to the supply part, the eaves sections 16 and 36 serve to protect the windings 2 and 4, and the increased areas of the joint surfaces S1 and S2 reduce the magnetic resistance of the gap between the primary core and the secondary core at said joint surfaces S1 and S2 advantageously.

Variant embodiment 2

Figure 3:
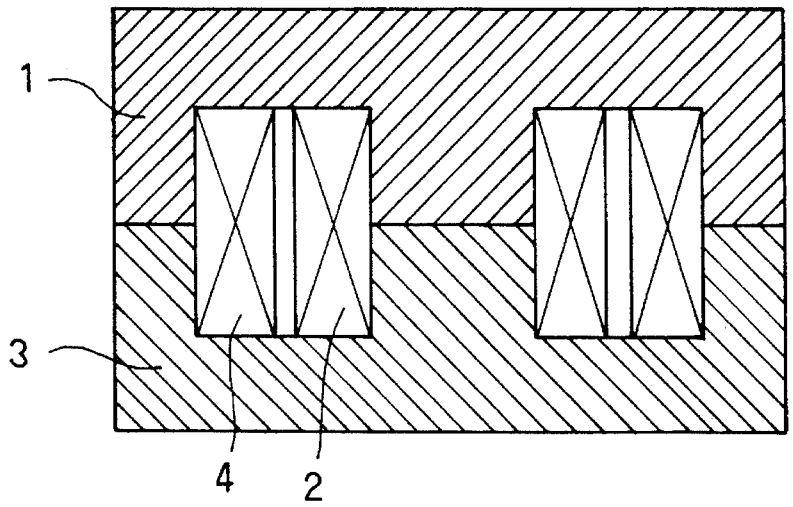
FIG. 3 is a cross-sectional diagram of the inventive power feeding device used for the test.

FIG. 3 shows another variant embodiment. In this embodiment, confrontation gaps are located at the middle of the central leg section 11 and outer leg sections 32 of the three-leg closed magnetic path core.

Figure 4:
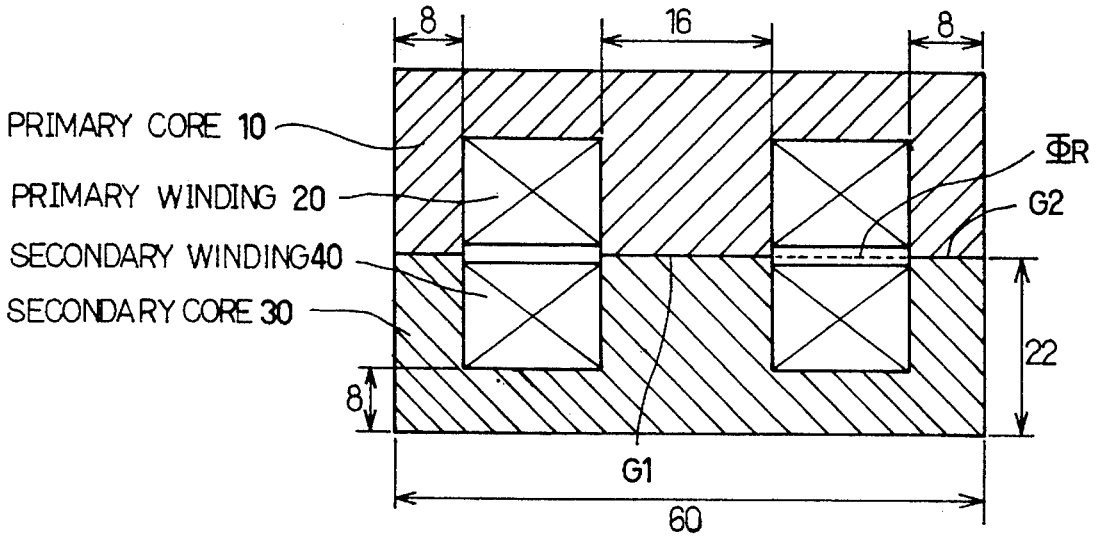
FIG. 4 is a cross-sectional diagram of the conventional power feeding device used for the test as an object of comparison.
Figure 5:
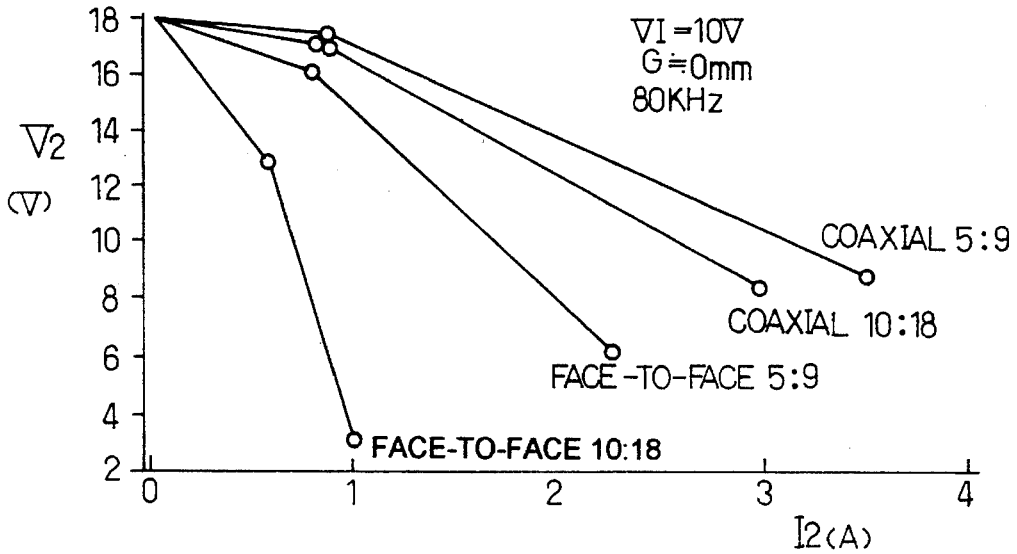
FIG. 5 is a characteristic graph showing the test result.

An experiment was conducted for comparing the performances of the inventive power feeding device of coaxial winding, three-leg closed magnetic path core type (showing FIG. 3) and the conventional power feeding device of face-to-face winding, three-leg closed magnetic path core type (shown in FIG. 4). FIG. 5 shows the result of experiment with the confrontation gap set virtually equal to zero, and FIG. 6 shows the result with the confrontation gap set equal to 0.5 mm.

Both power feeding devices are based on tile same three-leg closed magnetic path core consisting of cores 1 and 3 as shown in FIG. 3 and FIG. 4, with the principal dimensions being given in millimeters in FIG. 4 Two models a and b having different number of turns of the primary and secondary windings were fabricated, i.e., model a has a 5-turn primary winding and 9-turn secondary winding, and model b has a 10-turn primary winding and 18-turn secondary winding. The model "a" indicated as COAXIAL 5:9 or FACE-TO-FACE 5:9, and the model "b" is indicated as COAXIAL 10:18 or FACE-TO-FACE 10:18 in FIGS. 5 and 6 .

Figure 6:
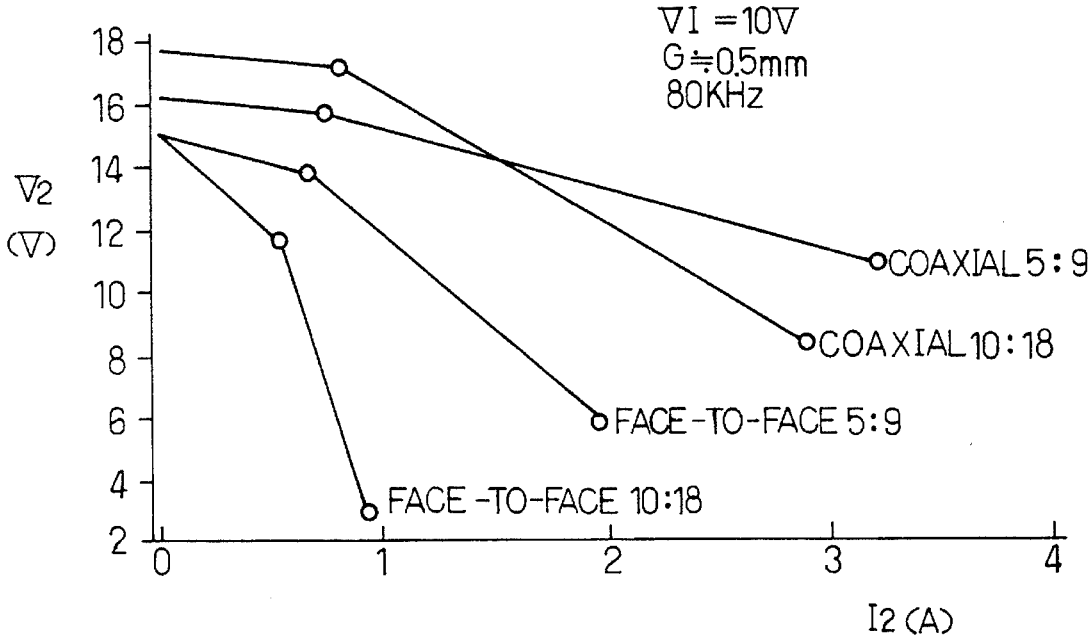
FIG. 6 is a characteristic graph showing the test result.

FIGS. 5 and 6 reveal that the inventive power feeding device based on the coaxial windings achieves a significantly higher power conversion efficiency as compared with the conventional device based on the face-to-face windings. A conceivable reason for these test results is that in the conventional device of face-to-face winding three-leg closed magnetic path core type shown in FIG. 4, the leakage flux ΦR emerging at the section between the gaps G1 and G2 with the strongest magnetic field does not intersect the secondary winding 40 at all.

Embodiment 2

FIGS. 7*a* and 7*b* show another embodiment of this invention. Shown in FIG. 7*a* is a front view of one core seen along the core axis, and shown in FIG. 7*b* is a cross-sectional view of both cores 5 and 6 taken along the core axis.

This embodiment is a power feeding device of the three-leg closed magnetic path core type using a primary core 5 and a secondary core 6 of the same cylindrical shape made of ferrite. Each core has two arc leg sections, which compare to the outer leg sections 32 of the first embodiment, and a central leg section 51 (61) having a shape of circular cylinder, with a through hole 55 (65) being formed in the center.

Both cores 5 and 6 have an outer diameter of D1=35.5 mm, an inner diameter of D2=29.9 mm, and a height of A1=11 mm. The through holes 55 and 56 have a diameter of 5.4 mm, and the central leg sections 51 and 61 have a diameter of 16 mm. Each core forms an annular groove having a depth of 7.3 mm for accommodating the winding.

The primary winding is a 10-turn winding and the secondary winding is a 18-turn winding. With a primary voltage of 10 volts and 80 kHz being applied to the primary winding, the output voltage induced across the secondary winding was measured. Both windings are wound coaxially and concentrically as in the first embodiment. For the comparison of performance, a device of the same core shape and same number of turns of windings disposed face-to-face as shown in FIG. 4 was fabricated.

Figure 8:
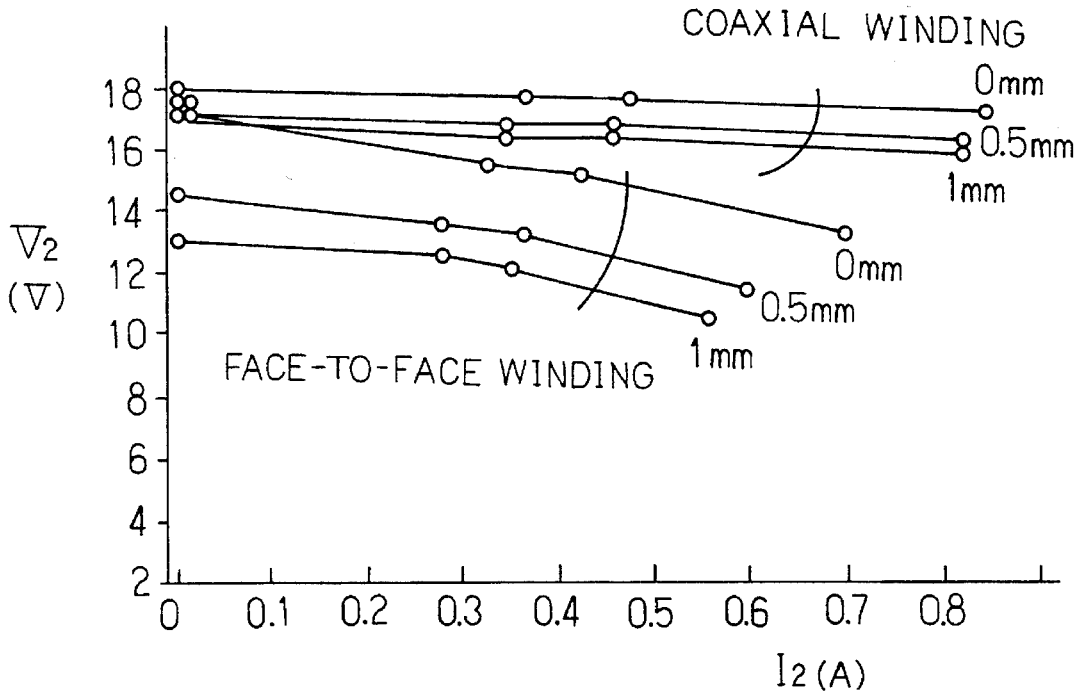
FIG. 8 is a characteristic graph showing the test result of the power feeding device shown in FIG. 7*a* and 7*b*.

FIG. 8 shows the result of measurement of the secondary voltage, with the confrontation gap being set to 0 mmf 0.5 mm and 1 mm, and it reveals that coaxial winding improves the secondary voltage significantly as compared with face-to-face winding.

Embodiment 3

FIGS. 9*a* and 9*b* show another embodiment of this invention. Shown by FIG. 9*a* is a front view of one core seen along the core axis, and shown by FIG. 9*b* is a cross-sectional view of both cores 7 and 8 taken along the core axis.

This embodiment is a power feeding device of three-leg closed magnetic path core type using a primary core 8 and secondary core 7 of cylindrical shapes made of ferrite. The primary core 8 consists of a disc-shaped base plate 81 and a circular cylinder for constituting a central leg section 82 extending from the center of the base plate 81. The secondary core 7 consists of a disc-shaped top plate 71 and a bore cylinder for constituting an outer leg section 72 extending from the circumference of the top plate 71.

A primary winding 9*b* and secondary winding 9*a* are accommodated in a space S which is defined by the base plate 81, top plate 71 and legs 72 and 82. The primary winding 9*b* is wound on the central leg section 82 and the secondary winding 9*a* is wound along the inner wall of the secondary core 7 so that both windings 9*a* and 9*b* are disposed coaxially and concentrically by being spaced out from each other by a prescribed distance.

This core structure prevents the magnetic flux from leaking to the outside, and the power conversion efficiency is improved due to the decrease of excitation current. Since gaps g1 and g2 are located far from each other along the core axis, the magnetic flux at the gaps gl and g2 scarcely leaks without intersecting the windings 9*a* and 9*b*, and consequently the power conversion efficiency is improved.

Figure 10:
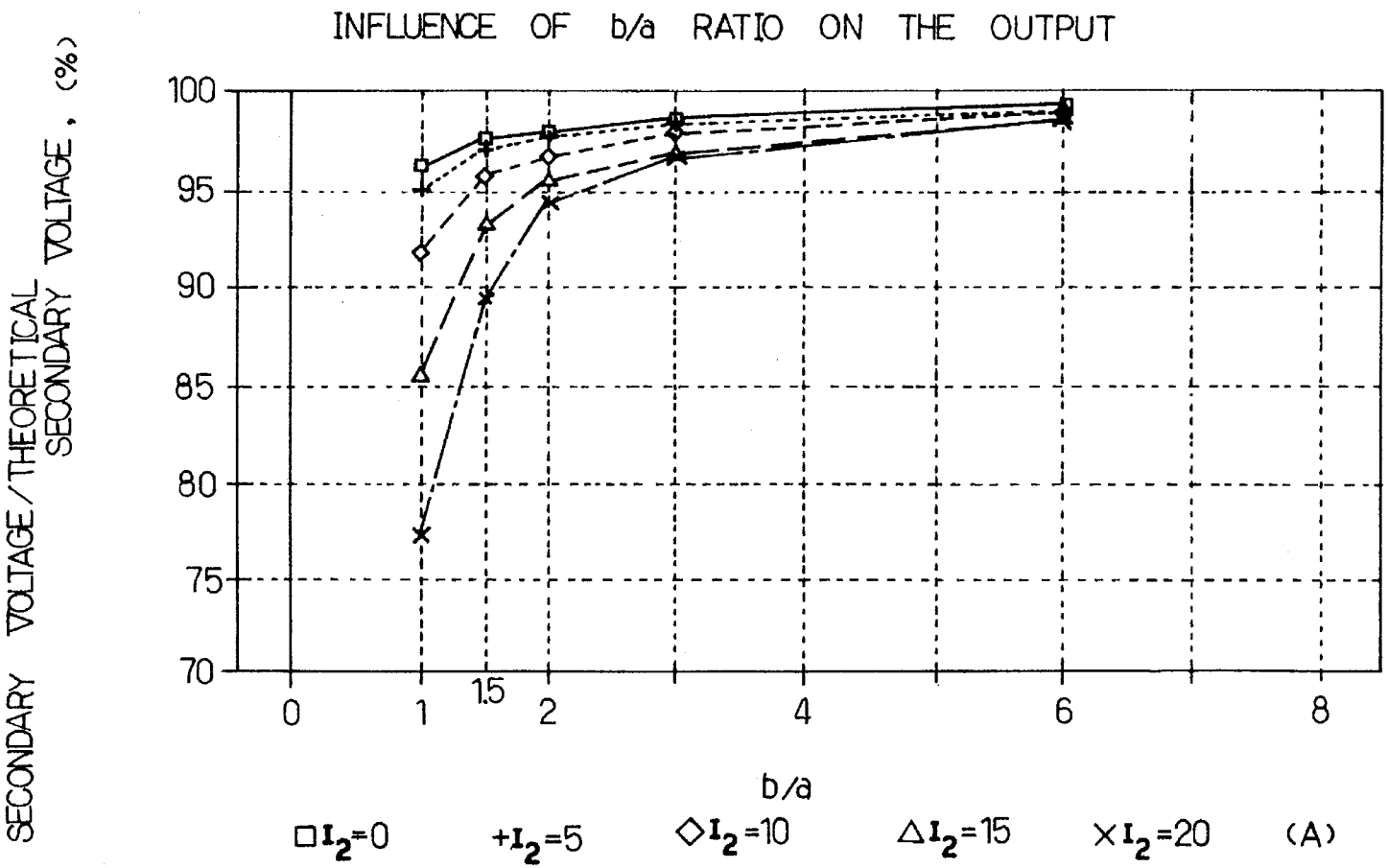
FIG. 10 is a characteristic graph showing the test result of the power feeding device shown in FIG. 9*a* and 9*b*.

According to the experiment, it was revealed that when the central leg section 82 of the primary core 8 is elongated in steps, the power conversion efficiency begins to rise sharply at a certain leg length. FIG. 10 shows the result of an experiment along with the conditions of the an experiment. The graph of FIG. 10 has a horizontal axis which represents the ratio of the longitudinal to lateral dimensions b/a of the cross section of the winding accommodation space S, i.e., a is the distance between the central leg section 82 and outer leg section 72 and b is the height of the winding 9*a* or 9*b* as shown in FIG. 9, and has a vertical axis which represents the voltage conversion efficiency that is the ratio of the actual secondary voltage to the theoretical secondary voltage (the primary voltage multiplied by the turn ratio).

The primary winding is a 10-turn winding, the primary voltage is 200 volts and 80 kHz, and the secondary winding is a 17-turn winding. Cores with cross-sectional longitudinal to lateral ratios b/a of 1, 1.5, 2, 3 and 6, with the winding accommodation space having a constant cross-sectional area axb, were used in the experiment. The secondary voltage was measured for the cases of secondary current $I_2$ of 0, 5, 10, 15 and 20 amperes for each core.

As common dimensions of these cores, the central leg section 82 has a radius of 15 mm, the outer leg section 72 has a thickness of 5 mm, the top plate 71 and base plate 81 have a thickness of 7.5 mm, and the confrontation gap is 1 mm. For the core set of b/a=1, a is actually 24.6 mm and b is actually 24.5 mm. For the core set of b/a=1.5, a is actually 20 mm and b is actually 30 mm. For the core set of b/a=2, a is actually 17.4 mm and b is actually 34.5 mm. For the core set of b/a=3, a is actually 14, 2 mm and b is actually 42.3 mm. For the core set of b/a=6, a is actually 10 mm and b is actually 60 mm.

FIG. 10 reveals that by selecting the cross-sectional ratio b/a of 1.5 or more, a 90% voltage conversion efficiency can be attained by selecting the ratio b/a of 2 or more, a 95% voltage conversion efficiency or higher can be attained, and by selecting the cross-sectional ratio b/a of three times or more, a 97% voltage conversion efficiency or higher can be attained. Namely, the larger the cross-sectional ratio b/a, the higher power conversion efficiency can be attained due to the decrease in the leakage flux.

This is true of the rectangular core structure which is the case of the first embodiment. The primary core 8 and winding 9*b* and the secondary core 7 and winding 9*a* can be exchanged without affecting the performance.

Increasing the cross-sectional ratio b/a in excess will incur increased iron loss and also increased core weight and dimensions, and therefore the ratio b/a is preferably set to 10 or smaller from this viewpoint.

What is claimed is:

1. A power feeding device based on the electromagnetic induction comprising:

a first core having a cup structure with a first base portion, a sidewall portion extending perpendicularly from the periphery of the first base portion, and a radially inwardly directed lip portion extending from a free end of said sidewall portion and establishing between the first base, sidewall and lip portions a first continuous channel in which is disposed a first winding; and a second core having a structure complementing said cup structure with a second base portion for covering an opening of said cup structure and an integral leg portion extending perpendicularly from said second base portion along a common central axis and terminating in a radially outwardly extending lip portion to form a second continuous channel about said leg portion and within which is disposed a second winding for disposition substantially concentrically within said first winding.

2. The power feeding device according to claim 1, wherein said first core and said first winding form a power receiving portion, and wherein said second core and said second winding form a power supply portion.

3. The power feeding device according to claim 1, wherein the radial width of said first winding is substantially equal to the depth of said first continuous channel.

4. The power feeding device according to claim 1, wherein the radial width of said second winding is substantially equal to the depth of said second continuous channel.

5. The power feeding device according to claim 1, wherein said first and said second continuous channels, when said first and second cores are assembled telescopingly, align to form an annular cavity having a height parallel to said central axis at least 1.5 times the radial width of said cavity.

6. A power feeding device based on electromagnetic induction comprising:

a first core having a cup structure with a first base portion, a sidewall portion extending perpendicularly from the periphery of the first base portion, and a radially inwardly directed lip portion extending from a free end of said sidewall portion and establishing between the first base, sidewall and lip portions a first continuous channel in which is disposed a first winding, said first core and said first winding forming a power receiving portion; and a second core having a structure complementing said cup structure with a second base portion for covering an opening of said cup structure and an integral leg portion extending perpendicularly from said second base portion along a common central axis and terminating in a radially outwardly extending lip portion to form a second continuous channel about said leg portion and within which is disposed a second winding for disposition substantially concentrically within said first winding, said second core and said second winding forming a power supply portion, said first and said second continuous channels, when said first and second cores are assembled telescopingly, align to form an annular cavity having a height parallel to said central axis at least 1.5 times the radial width of said cavity.

7. The power feeding device according to claim 6, wherein the radial width of said first winding is substantially equal to the depth of said first continuous channel.

8. The power feeding device according claim 6, wherein the radial width of said second winding is substantially equal to the depth of said second continuous channel.

* * * * *

UNITED STATES PATENT AND TRADEMARK OFFICE

CERTIFICATE OF CORRECTION

PATENT NO. : 5,506,560
DATED : April 9, 1996
INVENTOR(S) : Takeuchi et al

It is certified that error appears in the above-indentified patent and that said Letters Patent is hereby corrected as shown below:

Column 1, line 28, "copes" should read --cores--.

Column 2, line 64, "FIG." should read --FIGS.--; line 65, "FIG." should read --FIGS.--.

Column 3, line 2, "FIG." should read --FIGS.--; line 44 after "tens" insert --of--; line 65 "airspace" should read --air space--.

Column 5, line 1 "56" should read--65--; line 15 "mmf" should read --mm,--.

Column 5, line 53, delete "an"; line 58, delete "height of the winding", insert --length of the--;

Signed and Sealed this

Seventh Day of January, 1997

*Attest:*

*Attesting Officer*

BRUCE LEHMAN

*Commissioner of Patents and Trademarks*